US006854988B2

(12) United States Patent
Marmaropoulos et al.

(10) Patent No.: US 6,854,988 B2
(45) Date of Patent: Feb. 15, 2005

(54) MECHANISM FOR ELECTRICALLY CONNECTING AN ELECTRONIC DEVICE TO A GARMENT

(75) Inventors: George Marmaropoulos, Yorktown Heights, NY (US); Clive R. Van Heerden, Bronx, NY (US); Jack Mama, London (GB); Jeremy Wright, Langho (GB); Giang Truong Vu, London (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 54 days.

(21) Appl. No.: 10/185,882

(22) Filed: Jun. 28, 2002

(65) Prior Publication Data

US 2004/0002239 A1 Jan. 1, 2004

(51) Int. Cl.[7] ..... H01R 25/00

(52) U.S. Cl. ..... 439/110; 361/683; 607/108; 2/69; 439/37; 439/113

(58) Field of Search ..... 439/110–119, 285; 361/679, 683; 607/108; 2/69; 128/37

(56) References Cited

U.S. PATENT DOCUMENTS

| | | | | | |
|---|---|---|---|---|---|
| 1,963,554 | A | * | 6/1934 | Mcdill | 338/208 |
| 2,042,105 | A | * | 5/1936 | Kelley | 191/23 R |
| 2,287,915 | A | * | 6/1942 | Hardman | 219/211 |
| 2,437,579 | A | * | 3/1948 | Wilson | 439/118 |
| 2,579,383 | A | * | 12/1951 | Goodsmit | 219/211 |
| 3,017,469 | A | * | 1/1962 | Giller | 200/52 R |
| 3,622,936 | A | * | 11/1971 | Negishi | 439/285 |
| 3,639,709 | A | * | 2/1972 | Hart et al. | 200/51 R |
| 3,753,201 | A | * | 8/1973 | Ohman | 338/92 |
| 3,753,209 | A | * | 8/1973 | Hesse | 439/117 |
| 3,783,477 | A | * | 1/1974 | Hamilton et al. | 24/622 |
| 3,848,715 | A | * | 11/1974 | Hesse | 191/45 R |
| 4,099,303 | A | * | 7/1978 | Parera | 24/640 |
| 4,580,572 | A | | 4/1986 | Granek et al. | 128/639 |
| 4,751,773 | A | * | 6/1988 | Nysten | 24/681 |
| 4,861,273 | A | * | 8/1989 | Wenman et al. | 439/111 |
| 4,979,081 | A | * | 12/1990 | Leach et al. | 362/219 |
| 5,003,673 | A | * | 4/1991 | Nysten | 24/662 |
| 5,103,504 | A | * | 4/1992 | Dordevic | 2/243.1 |
| 5,179,743 | A | * | 1/1993 | Lanman | 5/498 |
| 5,295,055 | A | * | 3/1994 | Brock et al. | 362/249 |
| 5,329,592 | A | * | 7/1994 | Altman | 381/379 |
| 5,416,310 | A | * | 5/1995 | Little | 235/462.44 |
| 5,618,192 | A | * | 4/1997 | Drury | 439/110 |
| 5,625,903 | A | * | 5/1997 | Schultz et al. | 2/209 |
| 5,831,198 | A | * | 11/1998 | Turley et al. | 89/1.11 |
| 5,833,358 | A | * | 11/1998 | Patik | 362/391 |
| 5,844,656 | A | * | 12/1998 | Ronzani et al. | 351/158 |
| 6,014,773 | A | * | 1/2000 | Banks | 2/69 |
| 6,059,582 | A | * | 5/2000 | Tsai | 439/121 |
| 6,319,015 | B1 | * | 11/2001 | Faunce | 439/37 |
| 6,324,053 | B1 | * | 11/2001 | Kamijo | 361/683 |
| 6,381,482 | B1 | | 4/2002 | Jayaraman et al. | 600/388 |
| 6,540,372 | B2 | * | 4/2003 | Joseph | 362/147 |
| 6,563,424 | B1 | * | 5/2003 | Kaario | 340/572.1 |
| 6,596,955 | B2 | * | 7/2003 | Eves et al. | 200/550 |
| 6,716,042 | B2 | * | 4/2004 | Lin | 439/110 |

* cited by examiner

*Primary Examiner*—Tho D. Ta
*Assistant Examiner*—Larisa tsukerman
(74) *Attorney, Agent, or Firm*—Aaron Waxler

(57) ABSTRACT

A mechanism for electrically connecting various electronic devices to a garment is provided. The mechanism has a sliding track adapted to support a variety of different electronic devices. The sliding track has one or more channels enabling elective electrical communication between at least one electronic device and a power source. The electronic device is adapted to be selectively supported by the sliding track such that the electronic device can slide along the sliding track. The mechanism has one or more channels having at least one conductive element disposed therein. The first conductive element is shaped to conform to one or more channels to provide an ideal electrical contact surface. The one or more channels are adapted to selectively enclose or seal the conductive element.

25 Claims, 3 Drawing Sheets

MECHANISM FOR ELECTRICALLY CONNECTING AN ELECTRONIC DEVICE TO A GARMENT

FIELD OF THE INVENTION

The present invention relates to a mechanism for use in an article of clothing, wearable fabric or garment. More particularly, the present invention relates to a mechanism adapted to enable a user to electrically connect different electrically powered devices to a wearable fabric or garment.

BACKGROUND OF THE INVENTION

Efforts have been made previously to create clothes, fabrics and garments that incorporate electrodes for monitoring a condition of the wearer, such as an Electrocardiogram, or conductive fibers for electromagnetic screening. U.S. Pat. No. 4,580,572 to Granek et al. discloses a garment for delivering and receiving electric impulses which can include wires sewn onto the cloth or conducting cloth sewn onto non-conducting cloth.

However, although useful, these patents fail to address and combat the inherent problems of utilizing wearable electronics. There exist certain operational problems in wearable electronics. These operational problems include the interface between soft fabrics and hard product. This interface, for instance between a shirt and bulky computer or bulky sensory equipment can lead to uncomfortable results to the wearer of the article of clothing. Attaching a bulky product to the inside of a jacket or shirt can cause discomfort, cuts, burns, bruises and related injury to the wearer. Furthermore, there also exist problems associated with the decreased flexibility of the article of clothing that has a bulky hard product disposed therein. Generally, the comfort, flexibility and fit of an article decrease dramatically when a user adds bulky, heavy and inflexible electronic devices to the garment.

Additionally, there also are operational difficulties with regard to electrical connectivity between the electronic device and a circuit integrated in the article of clothing. Given the wide range of activities that the wearer may engage in, either rain or perspiration may penetrate or otherwise enter the electrical circuit. Fluid, perspiration and moisture may disrupt the operation of the wearable garment hence, the difficulties associated with the implementation in practice. Additionally, protection of the wearer of the garment from the detrimental attributes of an electronic device is a great concern.

A need, therefore, exists for a mechanism for electrically connecting various electronic devices to an article of clothing. There is also a need for an improved mechanism having a sliding track for carrying the various electronic devices, the sliding track having at least one channel, the channel selectively enclosing at least one conductive element disposed therein, the channel enabling selective access to the at least one conductive element. Further, there is a need for an improved mechanism having a sliding track for carrying the various electronic devices attached to an article of clothing that is comfortable, and flexible. Still further, there is also a need for an improved mechanism for electrically connecting an electronic device to a power supply that will not permit perspiration, fluid or moisture to interrupt the electrical connection and that is safe and not maintenance intensive.

SUMMARY OF THE INVENTION

There is provided a mechanism for electrically connecting various electronic devices to a garment. The mechanism has a sliding track for engaging and slidably supporting at least one electronic device. The sliding track has one or more channels with at least one conductive element disposed therein. The one or more channels selectively enclose or seal the one or more conductive elements so as to allow for the selective electrical communication between the at least one electronic device and a power source.

BRIEF DESCRIPTION OF THE DRAWINGS

Other objects, advantages and features of the present invention will be understood by reference to the following specification in conjunction with the accompanying drawings, in which like reference characters denote like elements of structure and.

DESCRIPTION OF THE PERFERRED EMBODIMENTS

Figure 1:
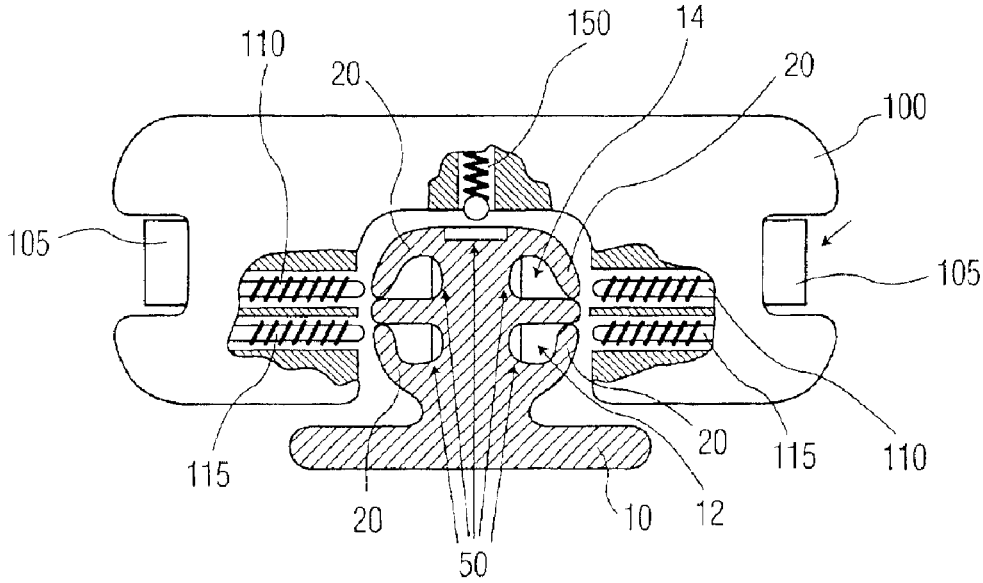
FIG. 1 is a cross sectional view of the mechanism for electrically connecting various electronic devices to an article of clothing of the present invention with the conductors in the open position.
Figure 2:
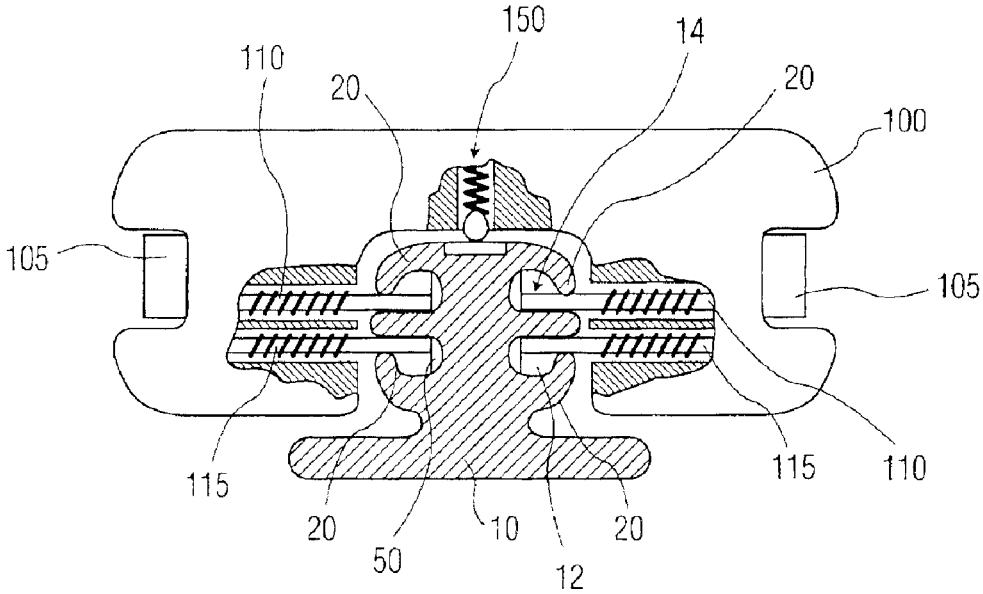
FIG. 2 is a cross sectional view of the mechanism for electrically connecting various electronic devices to an article of clothing of the present invention with the conductors in the closed position.

With reference to FIGS. 1 through 4, there is provided a mechanism for electrically connecting various electronic devices to an article of clothing in accordance with a first illustrative embodiment. The mechanism includes a sliding track 10 for carrying various electronic devices, such as for example diagnostic equipment, sensors, mobile computers, cooling devices and mobile telephones. Sliding track 10 may be stitched, knit, bonded, adhered or affixed via a hook and loop material to an article of clothing. Sliding track 10 preferably has a flat bottom surface that may be disposed adjacent to or attached to a garment. Sliding track 10 may be extruded from a suitable non-conductive material and may be cut or stitched to a garment, such as a shirt, pants, shoes, hat or coat. In one aspect of the present invention, sliding track 10 may be flexible and formed from rubber. Sliding track 10 preferably has a top or upper surface that preferably enables any complementary electronic device to be mounted or carried on an exterior surface of any garment with sliding track 10.

In a preferred aspect of the present invention, the top or upper surface of sliding track 10 preferably has a bulbous member with one or more channels. For example, sliding track 10 may have two lower channels 12 and two upper channels 14. Lower channels 12 and/or upper channels 14 may be formed as U shaped apertures cut out or extruded with sliding track 10 with curvilinear edges 20 that preferably define slits in the lateral sides of the sliding track 10. As shown, upper channels 14 and lower channels 12 preferably encapsulate or otherwise seal and/or insulate at least one first conductive material 50, such as, for example, a copper wire, a metal coated carbon fiber, a metallic fiber, a doped fiber, a conductive fiber, an conductive organic material or a conductive polymer. In this manner, upper channels 14 and/or lower channels 12 preferably may prevent moisture, perspiration or fluid from entering upper channels 14 and/or lower channels 12.

First conductive material 50 may, in one aspect of the present invention, be a lengthwise strip disposed in the respective upper channels 14 and/or lower channels 12. First conductive material 50 may be stitched, sewn or otherwise disposed in sliding track 10. First conductive material 50 may be any suitable material that may conduct electricity or photons particles. First conductive material 50 may be disposed in any suitable location in upper channels 14 and/or lower channels 12 so as to maintain the seal and/or insulation properties of upper channels 14 and/or lower channels 12. For illustrative purposes, the first conductive material 50 is shown on the respective lateral side walls of sliding track 10 preferably parallel to the vertical center axis of the sliding track 10. First conductive material 50 is preferably electrically connected to a power source (not shown). The power source may be a portable battery, a DC power source, solar power or any other suitable power supply for supplying electric current to first conductive material 50. In one aspect of the present invention, first conductive material 50 may be stitched, sewn or otherwise disposed in the garment to preferably facilitate an electrical connection between first conductive material 50 and the power source. In this aspect of the present invention, first conductive material 50 is preferably also insulated, such as, for example, by a thermally and electrically insulated coating to protect the wearer of the garment from any discomfort and/or injury.

As shown in FIG. 1, an exemplary attachable portable electronic device 100 for connecting to sliding track 10. Electronic device 100 is illustrated as a rectangular shaped device, however one skilled in the art should appreciate that electronic device 100 may be any suitable shape and size. Electronic device 100 may preferably have one or more spring biased buttons 105 disposed on the lateral sides thereof. Buttons 105 preferably each have one or more second conductive elements 110, 115. Second conductive elements 110, 115 are shown as cylindrical structures, however second conductive elements 110, 115 may be any suitable shape and size mechanically and electrically mate with one or more of the respective upper channels 14 and/or lower channels 12. Second conductive elements 110 and 115 may preferably penetrate or protrude through the respective edges 20 to interface or otherwise mate with at least one first conductive element 50, thereby preferably providing electric power to electronic device 100. Second conductive elements 110, 115 may preferably be made from any suitable electrically conductive material, such as, for example a copper wire, a metal, a conductive polymer, a metal coated carbon fiber, a doped fiber a metallic fiber, a wire, or any combination thereof. Second conductive elements 110, 115 preferably cooperate with one or more biasing members 120 to facilitate selectively connecting at least one second conductive element 110, 115 to at least one first conductive element 50. Each biasing member 120 may be, for example as shown, a coil spring disposed about each second conductive element 110, 115.

In another aspect of the present invention, electronic device 100 preferably has a contact 150 for connecting to a ground. Contact 150 is preferably disposed in the interior of electronic device 100, however it should be appreciated that contact 150 may be disposed in any suitable location in electronic device 100 for grounding electronic device 100.

In an exemplary embodiment of the present invention, the electronic device 100 may be any suitable product 100 that utilizes electric power such as a computing device, a semiconductor, a sensor for monitoring physical aspects of the wearer, a mobile telephone, a mobile information infrastructure or any other suitable portable electronic device that may be attached to a garment and add beneficial qualities to the wearer and user.

In use, device 100 may preferably be powered via first conductive element 50 and/or sliding track 10 in cooperation with second conductive elements 110, 115. That is, a user may, as desired, mount or engage device 100 with sliding track 10 and depress buttons 105 by imparting an axial force to at least one or both buttons 105 and in this manner cause second conductive elements 110, 115 to extend laterally in the direction toward sliding track 10 and/or first conductive element 50 to interact therewith.

Figure 3:
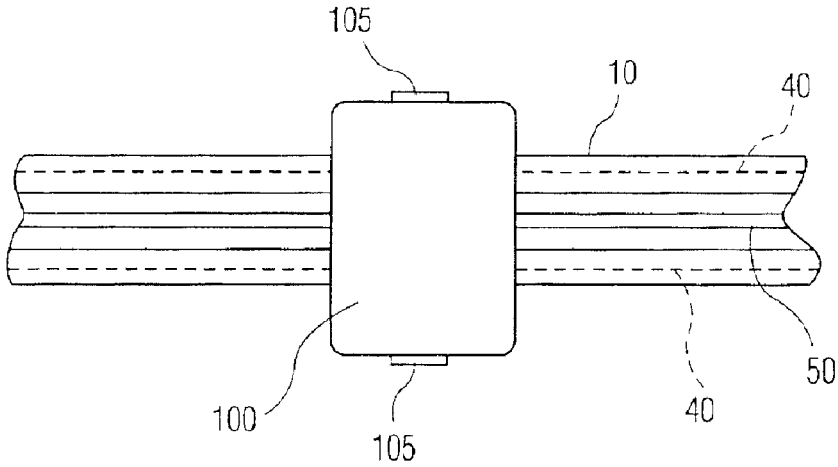
FIG. 3 is a top view of the mechanism for electrically connecting various electronic devices to an article of clothing.
Figure 4:
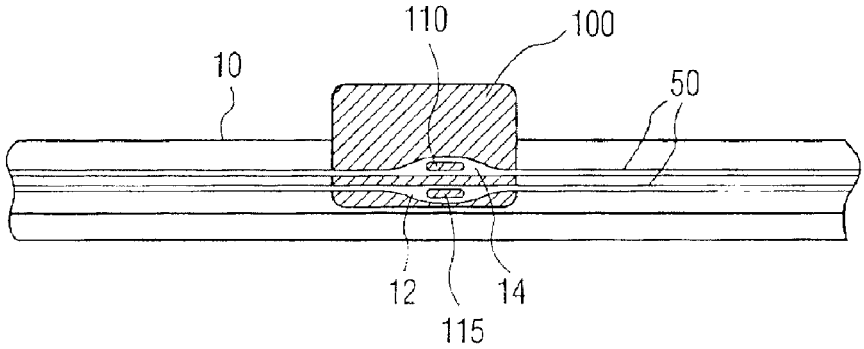
FIG. 4 is a side view of the mechanism for electrically connecting various electronic devices to an article of clothing.

Referring to FIG. 3 and FIG. 4, there is provided a respective top view and a cross sectional side view of an exemplary embodiment of the present invention for illustration purposes only. As can be understood from the drawings slider track 10 may be stitched to the garment by knit operation 40, for example. However, any known methods in the art for attaching slider track 10 to a garment may be utilized including, for example, an adhesive, a hook and loop operation and/or bonding. It is also noted that buttons 105 may preferably be placed in any suitable location on electronic device 100 so as to enable one or more second conductive elements 110, 115 to mate with one or more respective first channels 14 and/or one or more second channels 12. As previously stated, buttons 105 allow second conductive elements 110, 115 to interface with first conductive element 50 and transfer electrical power from first conductive element 50 to second conductive elements 110, 115 and ultimately to electronic device 100 for operational purposes.

In addition to the foregoing, it should be also appreciated by one skilled in the art, that electronic device 100 may slide, glide or otherwise traverse along the face of the garment, via sliding track 10, in substantially parallel relation to first conductive element 50 without a short circuit or an interruption in power. A preferred aspect of sliding track 10 is that the sealing and/or insulation of respective first channels 14 and respective second channels 12 is not disturbed by the sliding movement of electronic device 100. Respective first channels 14 and respective second channels 12 are preferably fabricated such that perspiration, fluid and/or moisture does not at any time enter the respective first channels 14 and respective second channels 12 to interrupt the transfer of power from first conductive material 50 to electronic device 100.

Figure 5:
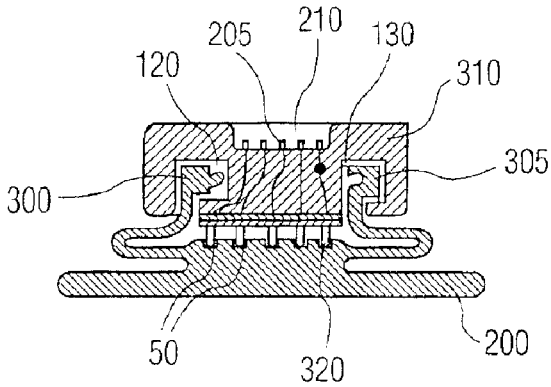
FIG. 5 is a cross sectional view of another exemplary embodiment of the mechanism for electrically connecting various electronic devices to an article of clothing.

Referring to FIG. 5, there is shown another aspect of the present invention wherein sliding track 10 is formed into a strip 200 preferably having two or more protective elements, a first protective element 300 and a second protective element 305 and one or more first conductive elements 50 preferably on an upper side thereof. An adapter 310 or intermediate element may be provided for cooperating with strip 200. Adapter 310, as shown, is a rectangular structure, however, adapter 310 may have any of a variety of different shapes, sizes and/or configurations. In the aspect of the present invention shown, adapter 310 preferably has one or more third conductive elements 320 preferably suitable for electrically interacting with at least one first conductive element 50. Preferably, first protective element 300 and second protective element 305 overlay and provide a seal, and/or to insulate each first conductive element 50 and/or third conductive element 320 disposed in strip 200.

As shown, any number of third conductive elements 320 may preferably be disposed on the bottom side of adapter 310 so as to preferably transmit a suitable amount of power from one or more first conductive element 50 through adapter 310 to an appropriate exemplary electronic device such as, for example, those identified above with respect to device 100. Thus, adapter 310 may preferably facilitate electrically and operatively connecting an electronic device to a garment incorporating strip 200. It is noted that first conductive element 50 may be disposed in any suitable location along strip 200. Strip 200 may be flexible and both thermally non-conductive and electrically non-conductive.

As shown, first conductive element 50 is preferably in spaced relation and adjacent to a first protective element 300 and second protective element 305. First protective element 300 and second protective element 305 preferably mate with one another to seal. In this manner, first protective element 300 and second protective element 305 prevent moisture, perspiration and/or fluid from entering and interrupting the flow of power through first conductive element 50 disposed in strip 200. First protective element 300 and second protective element 305 may preferably have any of a variety of connectors. For example, first protective element 300 can have a male member and second protective element 305 can have a complementary or mating female member.

It is noted that in another aspect of the present invention, first protective element 300 and second protective element 305 may be selectively and/or interchangeably attached to strip 200. It should also be appreciated by one skilled in the art, that strip 200 may be stitched or otherwise connected to the garment. Adapter 310 preferably has a socket 205 and/or a recess or aperture 210 for allowing conductive elements, such as, for example, second conductive elements 110, 115 discussed above with respect to device 100 to securely connect to socket 205 so that any of a variety of electronic devices similar to electronic device 100 may receive power when such electronic device is mounted to or engaged with adapter 310.

Figure 6:
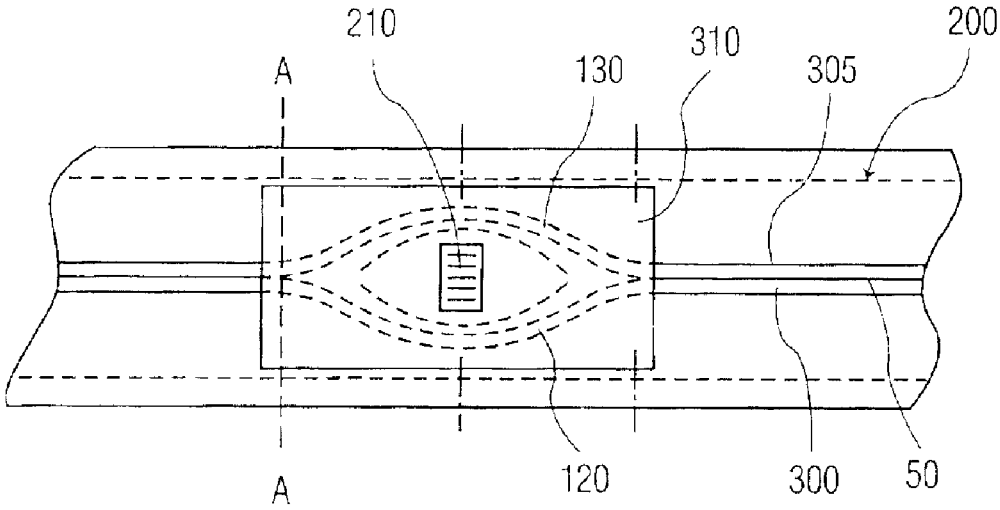
FIG. 6 is a top view of the mechanism of FIG. 5.

Referring to FIG. 6, first protective element 300 and second protective element 305, which preferably extend outward from strip 200, preferably have a suitable size, shape and/or configuration to preferably fit between a pair of channels 120, 130 of adapter 310 (also shown in FIG. 5) First and second channel 120, 130 may be curvilinear in shape and are preferably suitable to break sealed first and second protective elements 300, 305 to allow first protective element 300 and second protective element 305 to separate with respect to one another and pass through respective channels 120, 130. In this manner, an exemplary electronic device 100 may transverse strip 200 disposed on garment. As can be understood from the drawings, an electronic device may be operatively and/or electrically connected to socket 210 of adapter 310.

Figure 7:
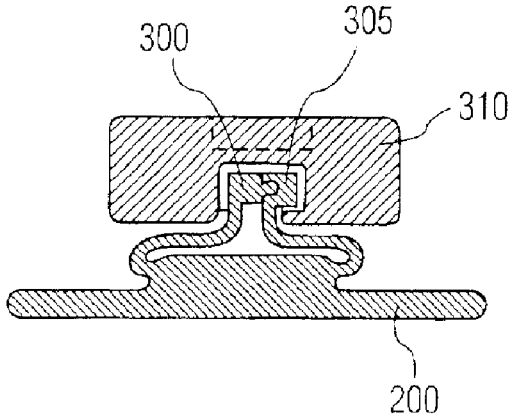
FIG. 7 is a cross sectional view of the mechanism along line A—A of FIG. 5.

Referring to FIG. 7, there is provided a cross sectional view along line A—A of the adapter 310. As can be understood from the drawings, first protective element 300 and second protective element 305 are preferably spread apart. First protective element 300 and second protective element 305 preferably pass through the respective first channel 120 and second channel 130 preferably in a curvilinear fashion as adapter 310 traverses strip 200. Along line A—A, first channel 120 and second channel 130 intersect to form a sole unified channel. After adapter 310 passes over a portion of the strip 200 curvilinear channels 120, 130 direct first protective element 300 to mate with second protective element 305 as shown in FIG. 7 to seal and encapsulate first conductive element 50. Thus, first protective element 300 and second protective element 305 preferably facilitate preventing moisture, perspiration and fluid from entering therein so that ininterrupted power may be transferred from a power supply (not shown) to the exemplary electronic device 100.

The present invention having been thus described with particular reference to the preferred forms thereof, it will be obvious that various changes and modifications may be made therein without departing from the spirit and scope of the present invention as defined in the appended claims.

What is claimed is:

1. A mechanism for electrically connecting an electronic device to a garment, comprising:

a flexible sliding track operatively associated with a garment and suitable for supporting at least one electronic device, wherein said flexible sliding track has one or more channels with at least one first conductive element disposed therein enabling selective electrical communication between said at least one electronic device and a power source.

2. The mechanism of claim 1, wherein said at least one electronic device is selectively supported by said flexible sliding track such that said electronic device can slide therealong.

3. The mechanism of claim 2, wherein said at least one first conductive element is shaped to conform with said one or more channels to provide an ideal electrical contact surface.

4. The mechanism of claim 2, wherein said one or more channels are suitable for enclosing said at least one first conductive element.

5. The mechanism of claim 4, wherein said one or more channels are suitable for sealing said at least one first conductive element to prevent fluid from making contact therewith.

6. The mechanism of claim 4, wherein said at least one electronic device has at least one second conductive element suitable for making electrical contact with said at least one first conductive element.

7. The mechanism of claim 6, wherein said at least one second conductive element is suitable for facilitating electrical communication with said at least one first conductive element.

8. The mechanism of claim 7, wherein said at least one second conductive element is suitable for securing said at least one electronic device to said sliding track.

9. The mechanism of claim 8, wherein said at least one second conductive element is adjustable via an actuator.

10. The mechanism of claim 1, wherein said sliding track is permanently connected to said garment by at least one of the group consisting of (a) a knit operation, (b) a bonding operation, (c) a stitch operation, (d) an adhesive operation, (e) a mechanical operation, or (f) any combination thereof.

11. A mechanism for electrically connecting an electronic device to a garment, comprising:

a flexible sliding track operatively associated with a garment and suitable for supporting one or more electronic devices, said flexible sliding track having one or more channels with at least one conductive element therein;

one or more adapters for connecting to said flexible sliding track and/or said one or more channels;

wherein said one or more adapters facilitate mechanically and electrically connecting one or more electronic devices to said garment via said flexible sliding track.

12. The mechanism of claim 11, wherein said at least one electronic device has at least one second conductive element and wherein said adapter has at least one third conductive element suitable for connecting said at least one second conductive element with said at least one first conductive element.

13. The mechanism of claim 12, wherein one or more channels have a first and a second protective element, wherein said first and second protective elements cooperate to seal said one or more channels while simultaneously allowing for electrical communication between said at least one third conductive element of said adapter and said at least one first conductive element of said one or more channels.

14. The mechanism of claim 13, wherein said first and said second protective elements are disposed between said one or more channels and said adapter, wherein said first and said second protective elements are shaped to conform with said sliding track such that said at least one first conductive element of said one or more channels is sealed to prevent fluid from making contact therewith.

15. The mechanism of claim 14, wherein said adapter is suitable for opening and closing said first and said second protective elements to allow said at least one third conductive elements to make electrical contact with said at least one first conductive element in said one or more channels.

16. The mechanism of claim 15, wherein said adapter is slidable along said sliding track such that the sealed integrity of said one or more channels is maintained while said at least one third conductive element is in electrical communication with said at least one first conductive element of said one or more channels.

17. A method for electrically connecting at least one electronic device to a garment, comprising the step of:

providing at least one flexible sliding track operatively associated with a garment and suitable for supporting at least one electronic device;

supporting said at least one electronic device on said flexible sliding track, said sliding track having at least one channel; and enabling selective electrical communication between said at least one electronic device and a power source.

18. The method of claim 17, further comprising the step of selectively supporting said at least one electronic device on said sliding track wherein said at least one electronic device slides on said sliding track.

19. The method of claim 18, further comprising the step of enclosing a first conductive element within said at least one channel.

20. The method of claim 19, further comprising the step of selectively sealing said first conductive element in said at least one channel, said at least one channel preventing fluid from entering said at least one channel.

21. The method of claim 20, further comprising the step of contacting at least one second conductive element to said at least one first conductive element in said at least one channel, said at least one second conductive element being part of said at least one electronic device.

22. The method of claim 21, further comprising the step of adjusting said at least one second conductive element to facilitate electrical communication between said at least one second conductive element and said at least one first conductive element, in response thereto.

23. The method of claim 20, further comprising the step of protecting said at least one channel by providing a first protective element and a second protective element, said first protective element and said second protective element cooperating to seal said at least one channel, while simultaneously allowing for selective electrical communication between at least one third conductive element.

24. The method of claim 23, further comprising the step of electrically connecting said at least one third conductive element to said at least one first conductive element, said at least one third conductive element being part of an adapter.

25. The method of claim 24, further comprising the step of fastening said electronic device to said adapter, such that a power source may transfer electrical power through said at least one first conductive element, said at least one second conductive element and said at least one third conductive element to said at least one electronic device.

* * * * *